United States Patent [19]

Ono et al.

[11] Patent Number: 4,933,602

[45] Date of Patent: Jun. 12, 1990

[54] APPARATUS FOR GENERATING LIGHT BY UTILIZING MICROWAVE

[75] Inventors: Tetsuo Ono, Kokubunji; Kenji Sekine, Tokyo; Seiichi Murayama, Kokubunji, all of Japan

[73] Assignee: Hitachi, Ltd., Tokyo, Japan

[21] Appl. No.: 155,507

[22] Filed: Feb. 12, 1988

[30] Foreign Application Priority Data

| | | | |
|---|---|---|---|
| Mar. 11, 1987 | [JP] | Japan | 62-54161 |
| May 22, 1987 | [JP] | Japan | 62-123798 |
| Jul. 8, 1987 | [JP] | Japan | 62-168656 |
| Jul. 10, 1987 | [JP] | Japan | 62-171144 |
| Sep. 2, 1987 | [JP] | Japan | 62-217805 |

[51] Int. Cl.[5] ..... H01J 7/46

[52] U.S. Cl. ..... 315/39; 315/111.21; 313/231.01

[58] Field of Search ..... 315/39, 248, 111.21, 315/111.31, 344, 267; 313/231.31, 231.41; 250/504 R, 493.1

[56] References Cited

U.S. PATENT DOCUMENTS

| | | | |
|---|---|---|---|
| 3,872,349 | 3/1975 | Spero et al. | 315/39 |
| 4,001,632 | 1/1977 | Haugsjaa et al. | 315/39 |
| 4,002,944 | 1/1977 | McNeill et al. | 315/248 X |
| 4,498,029 | 2/1985 | Yoshizawa et al. | 315/248 X |
| 4,507,587 | 3/1985 | Wood et al. | 315/39 |
| 4,532,427 | 7/1985 | Matthews et al. | 315/248 X |
| 4,673,846 | 6/1987 | Yoshizawa et al. | 315/39 X |

*Primary Examiner*—Eugene R. Laroche
*Assistant Examiner*—Seung Ham
*Attorney, Agent, or Firm*—Fay, Sharpe, Beall, Fagan, Minnich & McKee

[57] ABSTRACT

A light source apparatus for irradiating a large area with high intensity of light comprises a microwave cavity having a section of a flat shape and a plurality of electrodeless lamps disposed within the cavity in juxtaposition with one another in a flat array.

13 Claims, 11 Drawing Sheets

APPARATUS FOR GENERATING LIGHT BY UTILIZING MICROWAVE

BACKGROUND OF THE INVENTION

The present invention relates to a light source apparatus or an apparatus for generating ultraviolet and visible light rays utilizing microwave, which apparatus is suited for irradiating a large area.

As the apparatus for generating light by utilizing microwave (hereinafter also referred to as the light source apparatus) known heretofore, there can be mentioned a typical one disclosed in U.S. Pat. No. 3,872,349. In the case of this known light source apparatus, a lamp is disposed within an elongated cavity which is connected to a microwave generator. With this structure, microwave energy is transformed to plasma energy within the lamp and light is emitted. It is reported that the emission of light can take place even when the cavity is not in the resonant state. An advantage of this known light source apparatus can be seen in that no electrodes are required, which in turn means that the structure of the light source is extremely simplified. Besides, the useful life of the light source apparatus as a whole is lengthened significantly because of the absence of such problems as consumption of the electrode, emission of impurities from the electrode and the like. Further, the light source apparatus can enjoy a great freedom in the selection of substance or material with which the lamp is to be filled, because of no necessity of taking into consideration the reaction of the material with that of the electrode.

The lamp used in the prior known light source apparatus mentioned above is implemented in a linear or spherical configuration. It should however be mentioned that in the known light source apparatus, no consideration is paid concerning the irradiation of a large area. On the other hand, employment of the light source apparatus capable of irradiating a large area is often required in the specific fields typified by the process of manufacturing semiconductor devices. In reality, in the specific utilization field such as mentioned above, irradiation of a large area with high irradiance is often demanded.

SUMMARY OF THE INVENTION

Accordingly, an object of the present invention is to provide a microwave light source apparatus which is capable of irradiating a large area with high irradiance.

In view of the above object, it is proposed according to an aspect of the present invention that a microwave cavity is realized in a flat configuration, wherein a plurality of lamps are disposed within the cavity in juxtaposition with one another in a flat array and ignited simultaneously. One side face of a large area constituting a part of the flat cavity is implemented in the form of a mesh which is transparent to light emitted from the lamps.

In a preferred embodiment of the invention, the thickness of the flat cavity is selected to be not greater than ½ of the wavelength produced by a microwave generator, whereby higher irradiance can be obtained.

With disposition of a plurality of lamps within the cavity of flat configuration and simultaneous ignition or excitation thereof, irradiation of a large area with high irradiance can be accomplished.

By realizing the flat cavity in a thickness not greater than ½ of the wavelength of microwave, the presence of an electromagnetic standing wave can be precluded in the direction thicknesswise. Accordingly, disposition of the lamps close to the mesh transparent to light emitted therefrom will not involve any appreciable reduction in the light output of the light source apparatus. State alternatively, irradiance can be increased due to capability of positioning the lamps closer to the area to be irradiated.

DESCRIPTION OF THE PREFERRED EMBODIMENTS

Now, the present invention will be described in detail by reference to the annexed drawings.

Figure 1:
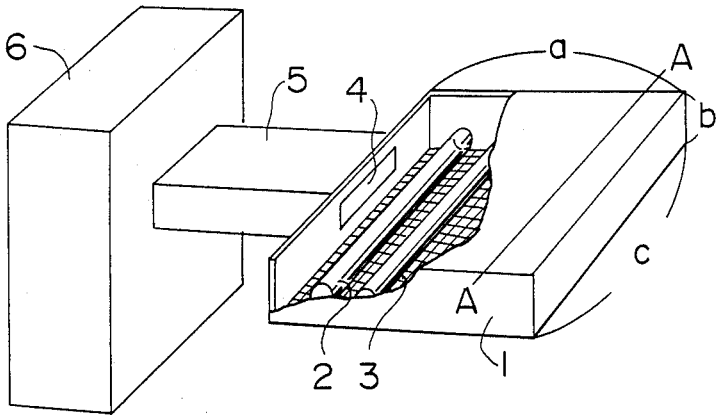
FIG. 1 is a perspective view showing, with a portion being broken away, a structure of the light source apparatus according to an embodiment of the present invention.
Figure 2:
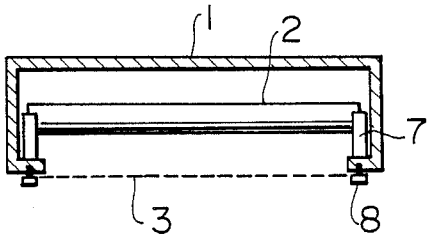
FIG. 2 is a view showing schematically, in a section taken along the line A—A in FIG. 1, a structure of a cavity incorporated in the light source apparatus according to an embodiment of the invention.

Referring to FIG. 1 which shows in a perspective view a light source apparatus according to an exemplary embodiment of the present invention, a cavity denoted by a reference numeral 1 is realized in the form of a rectangular parallelepiped and has a bottom face constituted by a mesh 3 to allow the light rays to be outputted or radiated therethrough. Formed in one side of the cavity 1 is a coupling window 4 through which microwave energy is supplied from a microwave generator 6 by way of a wave guide 5. FIG. 2 is a view showing the cavity 1 in a section taken along the line A—A in FIG. 1. The lamps 2 are fixedly held by respective fittings. The mesh 3 covering the open bottom of the cavity 1 is removably mounted by means of screws 8 or the like so that the lamps 2 can be released for replacement or for other purposes. Of course, the opening for replacing the lamp is not restricted to an open bottom of the cavity covered by the mesh 3. Other removable portions of the cavity may be provided to this end. Both of the cavity 1 and the mesh 3 are formed of metal. From the standpoint of easy manufacturing or workability, brass, copper, aluminum or the like metal is preferred for use in forming the cavity 1 and the mesh 3. The inner surface of the cavity should preferably be coated with silver with a view to increasing the electric conductivity and improving the light reflectivity so that the inner surface of the cavity can serve as a good light reflector. Each of the lamps 2 is constituted by a hermetically sealed glass tube or envelope which is filled with various gases, metals and compounds thereof, as will be described hereinafter. Microwave energy coupled or injected into the cavity 1 through the coupling window 4 is transformed to plasma energy within the lamp 2, whereby gases or metals filled therein are excited, resulting in that energy is released in the form of de-excitation radiation. The materials charged in the lamp 2 may vary in dependence on the intended applications of the light source apparatus. For example, when the light source apparatus is used in the application where visible light is to be made use of, the lamp may be filled with Hg, Na, Ti, In, Th, Sn or halides thereof and a rare gas at several ten Torr. On the other hand, when the light source apparatus is used in application where ultraviolet light is utilized, the tubular envelope of the lamp 2 should preferably be made of quartz, sapphire, $CaF_2$, $MgF_2$, LiF or the like having a high transmissivity to the ultraviolet rays. To this end, quartz containing scarcely metal impurities is preferred in consideration of excellent easy workability. On the other hand, as the substance suited for filling the lamp 2, there can be mentioned Hg, Zn, Cd, Se, As or halides thereof and a rare gas or $I_2$, $H_2$, $D_2$ (heavy hydrogen), Xe or the like. The length of the lamp 2 may vary in dependence on the intended utilization of the light source apparatus as well as size of the cavity 1. Usually, the lamp in the form of a linear tube has a diameter on the order of 0.5 cm to 3 cm. The microwave generator 6 produces microwave energy (electromagnetic wave having a wavelength of several millimeters to several ten centimeters). The microwave energy may vary in dependence on the intended application of the light source apparatus and usually lies in a range of several hundred watts to several thousand watts. For the practical purpose, a magnetron capable of generating microwaves at a frequency of 2.45 GHz (with a wavelength of 12.24 cm) is preferred as the microwave generator.

Figure 3:
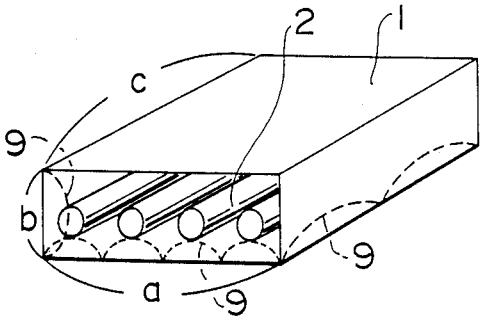
FIG. 3 is a view illustrating schematically a cavity realized in the form of a rectangular parallelepiped.

Next, description will be directed to the dimension or size of the cavity 1. FIG. 3 is a view for illustrating the generation of standing waves of electric fields upon occurrence of ideal resonance between the cavity 1 of the rectangular parallelepiped and the microwave. When the cavity is realized in the form of a rectangular parallelepiped having sides of lengths a, b and c, the following relation (1) applies validly to the numbers e, m and n of the standing waves making appearance along the individual sides of the cavity. Namely, $$(l/a)^2+(m/b)^2+(n/c)^2=(2/\lambda_0)^2 \quad (1)$$

where $\lambda_0$ represents the resonance wavelength. In FIG. 3, the standing waves are indicated by broken line curves. In this case, the individual lamps may be disposed in juxtaposition at positions corresponding to maxima of the standing waves, respectively. In practice, however, a relatively large amount of energy is consumed by the lamp 2, as a result of which a Q-value of the cavity 1 is decreased. Consequently, the lamps 2 are ignited even when the cavity 1 does not resonate in the empty state. Further, when the thickness of the cavity 1 equivalent to the value of the side b satisfies the condition that $b<\lambda_O 2$, no standing wave can make appearance at the side b. Accordingly, even when the lamp 2 is moved in the direction b, brightness of the lamp 2 can remain unchanged and thus the lamps can be disposed directly on the mesh 3. Thus, the cavity realized in the form of rectangular parallelepiped brings about advantages mentioned below.

In the case of the semiconductor manufacturing process, by way of example, high illuminance or irradiance of ultraviolet light is often demanded. In order to increase irradiance, the distance between the lamp and the surface of a target to be irradiated will have to be made as short as possible. For satisfying this requirement, the lamps 2 within the cavity 1 must be disposed as closely as possible to the mesh 3. This can be accomplished by selecting the factor b so that $b<\lambda_0/2$. Let's assume, for example, that a magnetron ($\lambda_0=12.24$ cm) is employed as the microwave generator 6. In that case, the length of the side b (thickness of the cavity 1) may be selected to be smaller than 6.12 cm. It is desirable that the distance between the lamp 2 and the mesh 3 is smaller than 1 cm.

Figure 4:
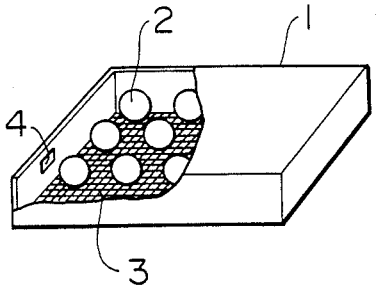
FIG. 4 is a perspective view showing another embodiment of the cavity structure according to the invention with a portion being broken away.

The geometrical configuration of the lamp 2 is never restricted to the linear tubular form but a plurality of lamps each having a spherical form may be employed, as is shown in FIG. 4. In this case, the diameter of the lamp 2 may range from 0.4 cm to 4 cm.

Figure 5:
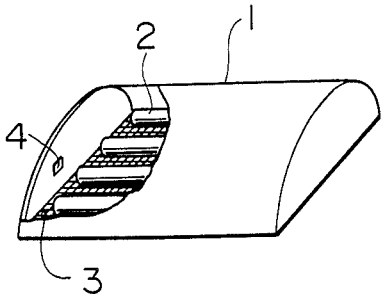
FIG. 5 is a view similar to FIG. 4 and shows still another embodiment of the cavity structure according to the invention.

The geometrical configuration of the cavity 1 is not limited to the form of a rectangular parallelepiped. For example, such a shape of the cavity as shown in FIG. 5 may be equally employed.

Figure 6:
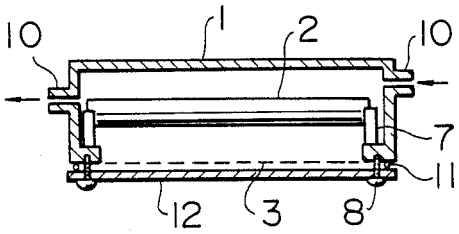
FIG. 6 is a sectional view for illustrating the operation of a cavity structure according to another embodiment of the invention.

FIG. 6 shows a cavity structure according to another embodiment of the invention which is provided with gas flow ports 10. In the figure, a gas flow taking place within the cavity is indicated by arrows. The gas flow serves for two functions. First, with the gas flow, cooling of the lamps 2 can be accomplished. In this connection, it is noted that the light emission efficiency of the lamp depends on the vapor pressure of the material or substance which fills the glass envelope. Accordingly, by controlling the vapor pressure of the substance filling the glass envelope by using the gas flow, the light emission efficiency of the lamp can be improved. The second function of the gas flow resides in gas replacement within the cavity. When ultraviolet light radiating from the lamp 2 is to be made use of, it is required to prevent the ultraviolet light rays from being absorbed by oxygen contained in the air. To this end, the interior of the cavity 1 will have to be filled with nitrogen or rare gas. In this case, the cavity 1 must be held in a more or less hermetically sealed state. Accordingly, a quartz plate 12 is mounted on the cavity 1 through interposition of a packing 11 at the inner or outer side of the mesh 3.

Next, discussion will be made on the efficiency of the lamp. It is first noted that the lamp efficiency undergoes a variation in dependence on the temperature and that the optimal temperature varies in dependence on the types of material filling the lamp envelope. Let's take as an example a lamp 2 which is filled with mercury and a rare gas for the purpose of making use of the mercury line spectrum of 254 nm. In that case, the desired lamp efficiency can be maintained at maximum by keeping the temperature of the lamp 2 at a value in a range of 30° C. to 60° C. In the case of the lamp filled with Cd or Zn, the ultraviolet light rays of high irradiance can be produced by maintaining the lamp temperature in ranges of 200° C. to 300° C. or 300° C. to 400° C., respectively. When the lamp temperature becomes lower than the optimal temperature range exemplified above, the amount of energy to be coupled or injected may be increased and/or the cavity may be heated by a suitable heating means provided externally of the cavity. On the other hand, when the lamp temperature increases beyond the optimal range, measures described below in conjunction with FIG. 7 may be adopted.

Figure 7:
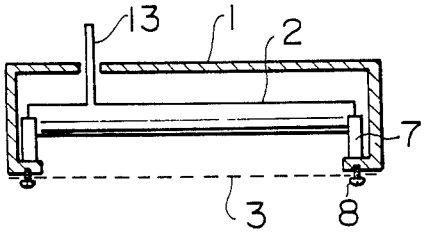
FIG. 7 is a view similar to FIG. 6 and shows another embodiment of the cavity structure according to the invention.

More specifically, FIG. 7 shows a cavity structure according to another embodiment of the present invention. In the case of this cavity structure, holes each having a diameter smaller than the cut off wavelength of the microwave are formed in the cavity, wherein branch tubes 13 are formed in the lamp 2 so as to project outwardly through the associated holes. With this structure, the lamp operation can be maintained at a high efficiency by controlling the temperature of the branch tube 13 to the optimal value. Parenthetically, when the lamp 2 is filled with a metal or halide thereof, there may arise a problem that the metal or halide is deposited on the inner surface of the lamp 2 to thereby interfere with the light output efficiency. This problem can be solved by disposing a portion of the lamp 2 exteriorly of the cavity 1 as described above and thereby collecting the filling material in the outwardly projecting portion.

In a modification of the embodiment shown in FIG. 7, the length of the tubular lamp 2 may be increased so that one end portion thereof can extend through a hole formed in a side wall of the cavity to project outwardly, provided that the lamp envelope is of a linear tube. In this case, the branch tube 13 may be spared.

When a plurality of lamps 2 of different types are disposed within the cavity 1, light rays of different wavelengths suited preferably for the aimed irradiations can be generated simultaneously. By way of example, suppose an array in which the lamps filled with Hg and those filled with Cd are alternately juxtaposed with one another. Then, the ultraviolet rays having mercury line spectrum of 254 nm and cadmium (Cd) line spectrum of 229 nm, respectively, can be generated simultaneously. In that case, however, the lamps of both types mentioned above differ from each other in respect to the optimal efficiency temperature. Accordingly, it is desirable that a portion of each lamp is projected outwardly from the cavity, as described above, for controlling the temperatures of the different type lamps separately.

Figure 8:
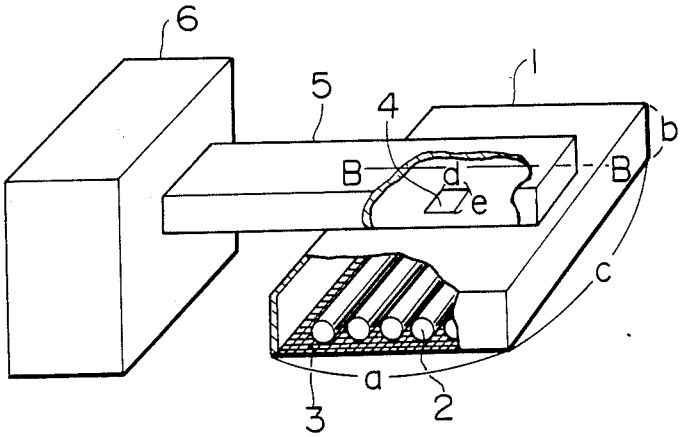
FIG. 8 is a view similar to FIG. 1 and shows a light source apparatus according to another embodiment of the present invention.

Referring to FIG. 8, the coupling window 4 for the microwave energy may be provided at a top side of the cavity 1 for substantially the same effect.

Next, description will be made on the energy level of the microwave and the irradiance of the lamp.

In the light source apparatus shown in FIGS. 1 and 8, a plurality of lamps must be excited or ignited simultaneously. It has been experimentally shown that more than 0.73 $W/cm^3$ is required per unit volume of the lamp for realizing the simultaneous ignition or excitation mentioned above. More specifically, in the experiment conducted by the inventors, a magnetron was used as the microwave generator 6. The waveguide had a cross section of 5.4 cm$\times$10.9 cm. The size of the cavity 1 was selected such that a =25 cm, c =35 cm and b =6 cm. Each of the lamps 2 was formed of a quartz tube having an inner diameter of 1 cm and a length of 29 cm and filled with Ar at 2.5 Torr and a trace of Hg. Twelve lamps 2 each of the above-mentioned structure were juxtaposed in the array shown in FIG. 8 with the intercenter distance of 2 cm therebetween. Accordingly, the total volume of the lamps amounts to 273 $cm^3$. Each of the lamp 2 was provided with a thin branch tube projecting externally of the cavity and subjected to the temperature control so that temperature of the projecting portion was maintained constant at 40° C. At this temperature, the intensity of the mercury line spectrum of 254 nm assumes approximately the maximum value. For realizing the impedance matching with the microwave, a 3-stub tuner was inserted between the cavity 1 and the microwave generator 6. The coupling window 4 was of a circular form having a diameter of 4 cm in the case of the light source apparatus shown in FIG. 4, while in the apparatus shown in FIG. 8, the coupling window 4 was of a rectangular form having sides e =4 cm and d =10 cm. The coupling window 4 was formed approximately at the center of one side face of the cavity in the former case (FIG. 4) while it was formed in the top face of the cavity substantially at the center thereof in the case of the apparatus shown in FIG. 8. Although the lamps can be excited or ignited even when the coupling window is provided at other positions other than the center, the centered disposition of the coupling window is preferred in view of the attainable uniformity of radiation. Both apparatuses were tuned so that the reflected power was approximately zero watts, and ignition of the lamps 2 was repeated by varying the input microwave energy or power. The results of the experiment described above show that input power higher than 200 W in total is required for causing all the lamps to be ignited or excited stably in both apparatuses. The requisite power is 0.73 W/cm$^3$ in terms of wattage per unit volume of the lamp. With the aid of the light source apparatus dimensioned as mentioned above, it is possible to irradiate a Si-wafer of 20 cm in diameter with ultraviolet rays.

Figure 9:
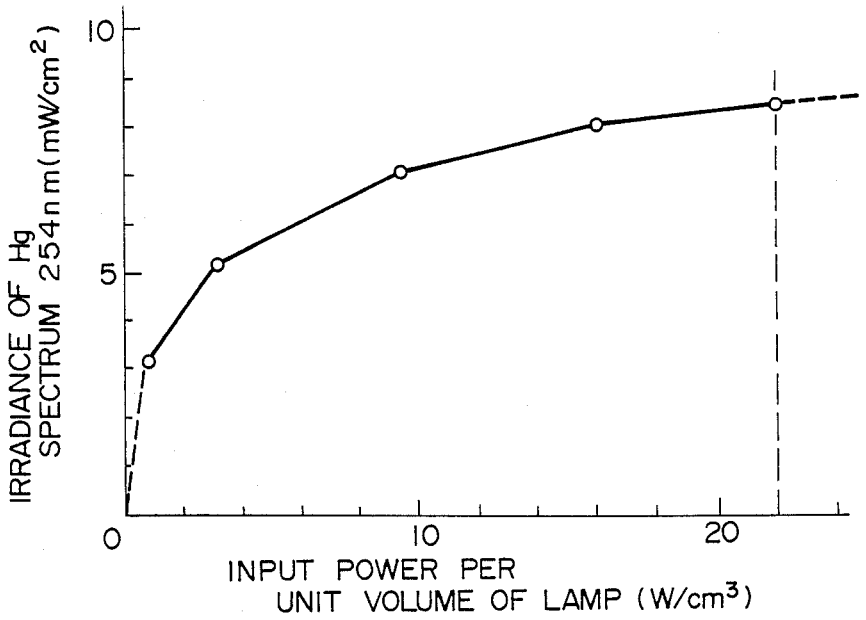
FIGS. 9 and 10 are views for graphically illustrating the characteristics of ultraviolet light strength in the light source apparatus according to the invention.

FIG. 9 illustrates graphically the results of measurement conducted for determining the relation between the power density and intensity or strength of mercury line spectrum of 254 nm. In this measurement, the cavity 1 was of a rectangular parallelepiped in a size of 22×22×5.4 cm and has two tubular lamps 2 of 1 cm in diameter and 20 cm in length, both lamps being mounted approximately at the center of the cavity. Irradiance of the mercury line spectrum of 254 nm was measured in a plane positioned with a distance of 10 cm from the lamps 2. The lamp temperature was controlled in the same manner as described above. The irradiance increases as the input power is increased and attains ultimately saturation. The results of the measurement show that the efficiency is degraded when the input power increases beyond 22 W/cm$^3$. Substantially similar results were obtained in the measurements in which Cd line spectra of 229 nm and 326 nm and Zn line spectra of 214 nm and 308 nm were used. When these metals are employed, it is however required that the temperature of the coldest spot lies in the range of 200° C. to 400° C. as described hereinbefore.

The cavity used in the experiment or measurement mentioned above are so dimensioned as to resonate with the magnetron microwave frequency of 2.45 GHz in the empty state in which no lamps are mounted. It has however been found that the lamp 2 can be equally ignited even when the cavity does not resonate with the microwave of 2.45 GHz in the empty state (i.e. having no lamps mounted). In the experiment, it is confirmed that the lamps 2 can be equally ignited when the cavity of 25×30×6 cm is used.

Figure 10:
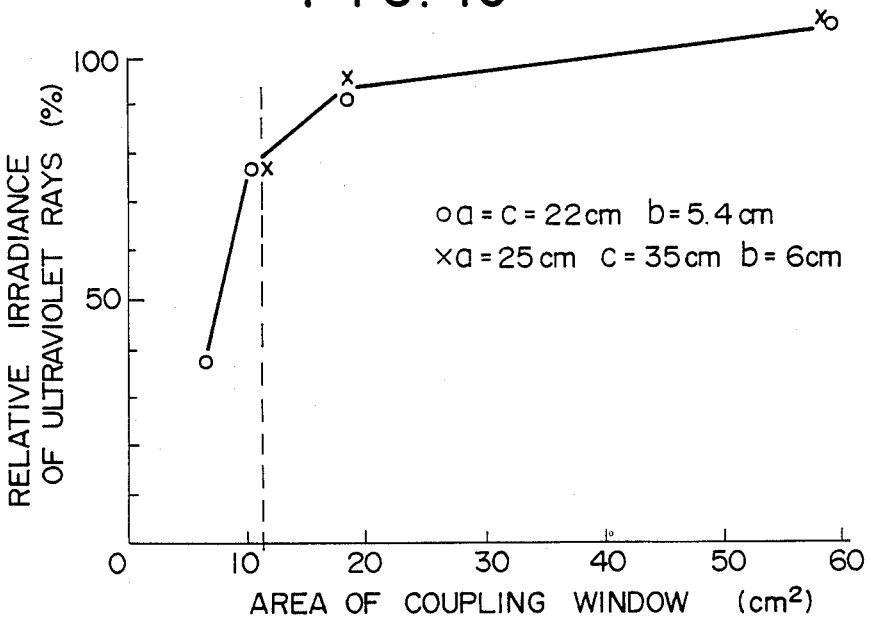

Now, the description will be turned to the area of the coupling window 4 required for igniting or lighting the lamp with high efficiency. FIG. 10 shows the results of an experiment conducted for the light source apparatus including the cavity 1 having the coupling window 4 formed in the side wall, as shown in FIG. 1. In the experiment, irradiance of the lamp 2 at the mercury line spectrum of 254 nm was measured in a plane disposed with a distance of 20 cm from the lamp 2 while varying the area of the coupling window 4. In one cavity of 25×35×6 cm in size, twelve tubular lamps each having a length of 29 cm were disposed, while in another cavity of 22×22×5.4 cm in size, ten tubular lamps each of 20 cm in length were mounted. In both cases, irradiance was calibrated to be 100% for the same size of the coupling window 4 as the sectional area of the wave guide (10.9×4.4=58.9 cm$^2$). The input power was maintained constant at 400 W. The reflecting power was adjusted to be approximately zero by means of the tuner. As the area of the coupling window 4 becomes smaller, irradiance of the lamp 2 is decreased even for the same input power because the microwave energy is difficult to injected into the cavity and is additionally consumed in the tuner. It has been found that sufficient irradiance can be obtained when the coupling window has an area which is greater than 12.6 cm$^2$ (circular window of 4 cm in diameter), while with the coupling window area of 7.1 cm$^2$ (a circular window of 3 cm in diameter), irradiance is decreased steeply and the lamps can not be ignited in the extreme case. In practical application, the matching should desirably be accomplished without using the tuner. It was shown that the length of the wave guide and the shape of the coupling window 4 have to be adjusted in dependence on the cavity 1 and the lamps 2 as used. The area of the coupling window 4 should be larger than about 12 cm$^2$. More preferably, the sectional shape and area of the coupling window 4 should be matched at least approximately with those of the wave guide. When the thickness b of the cavity 1 is smaller than that of the waveguide, the coupling window 4 should preferably have a width approximating to that of the waveguide and a height approximating to the thickness b of the cavity 1.

Figure 11:
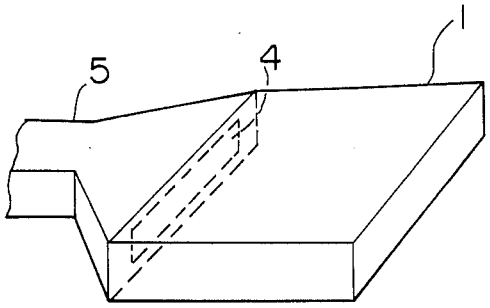
FIG. 11 is a perspective view showing a cavity structure according to a further embodiment of the invention.

FIG. 11 shows a structure of the cavity according to another embodiment of the present invention. As will be seen in the figure, a tapered waveguide 5 may be used for interconnecting the cavity 1 and the microwave generator 6.

Figure 12:
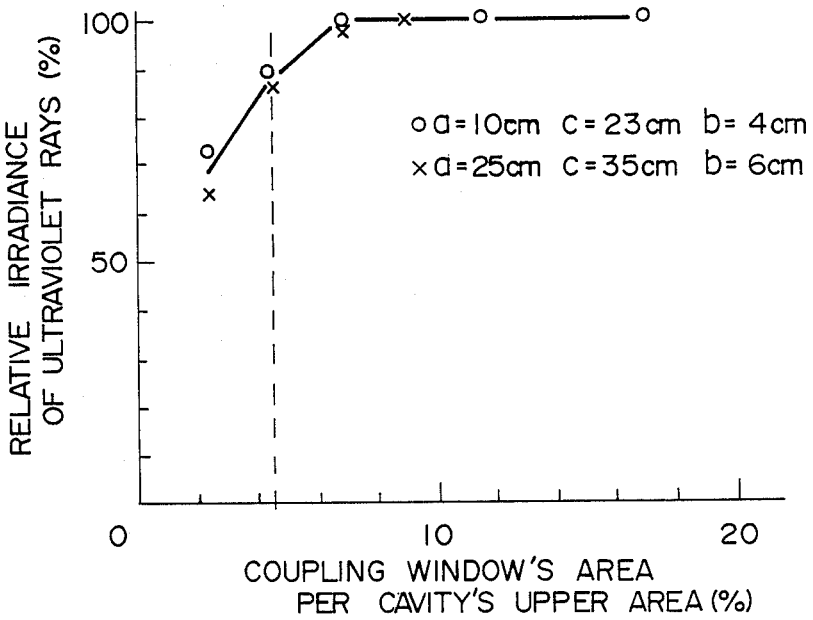
FIG. 12 is a view for graphically illustrating the characteristic of ultraviolet light strength in a light source apparatus according to the invention.
Figure 13:
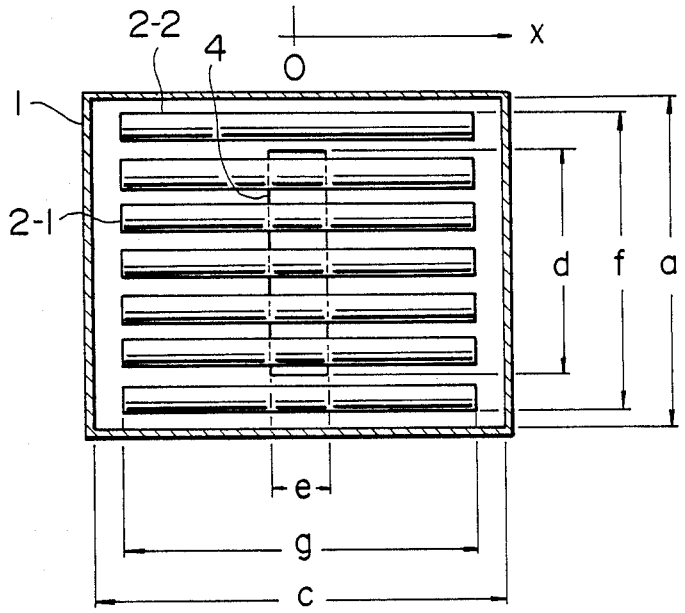
FIG. 13 is a plan view showing an exemplary disposition of lamps within a cavity according to the teaching of the invention.
Figure 14:
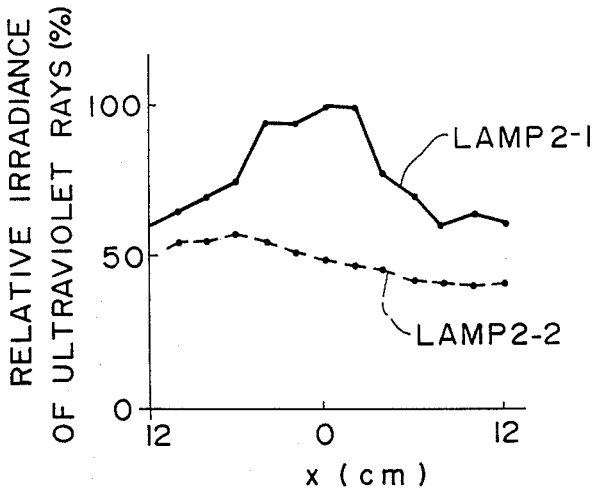
FIGS. 14 and 15 are views for graphically illustrating the characteristics of ultraviolet light strength in the light source apparatus according to the invention.
Figure 15:
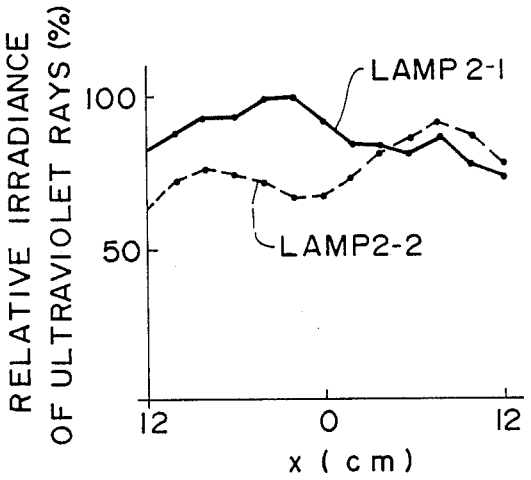

FIG. 12 shows the results of an experiment conducted on the light source apparatus in which the coupling window 4 is formed in the top face of the cavity 1. It has been experimentally confirmed that there exists a dependent relation between the size of the cavity 1 and that of the coupling window 4. As will be seen from the results of the experiment, sufficient irradiance can be obtained by providing the coupling window 4 of an area greater than 4.5% than that of the top face of the cavity. More specifically, in one cavity of 25×35×6 cm in size, twelve lamps each having an inner diameter of 1 cm and a length of 29 cm were mounted. In the other cavity of 10×23×4 cm, four lamps each having an inner diameter of 1 cm and a length of 20 cm were mounted. Irradiance was measured in a plane positioned with a distance of 20 cm from the lamp 2 and was calibrated to be 100% for the maximum value measured in the cavities, respectively. In the case of the smaller cavity, the coupling window 4 is formed in a square shape with the area thereof being varied. In the larger size cavity, the dimension e was set constant at 4.5 cm while the dimension d was varied to thereby vary correspondingly the area. The input power was maintained constant at 400 W with the reflected power being regulated to be approximately zero by means of the tuner. As in the case of the preceding experiments, little microwave energy can be injected into the cavity 1 when the area of the coupling window 4 is smaller than 4.5% of the cavity top area because of energy consumption in the tuner, resulting in that irradiance is decreased. For attaining sufficient irradiance, the area of the coupling window 4 should be selected to be greater than 7% of the top face area of the cavity 1. Further, it was found that by realizing the coupling window 4 in an elongated form in the cavity top wall, uniformity of irradiance distribution of the light source apparatus can be improved. FIG. 13 shows an arrangement and a size of the coupling window 4 formed in the cavity and the lamps 2 mounted therein. FIGS. 14 and 15 show irradiance distributions of the lamps 2 measured by varying the size of the coupling window 4. Dimensions of the cavity were such that a =25 cm, b =6 cm and C = 35 cm. The lamp 2 has an inner diameter of 2 cm, a length of 30 cm and is filled with Ar at 2.5 Torr and Hg. Seven lamps were mounted in juxtaposition with equal distance therebetween and with a space of 3 mm from the cavity top wall in which the coupling window 4 was formed, as shown in FIG. 13. The length f (FIG. 13) of the area covered by the lamp array was 22 cm. On these conditions, irradiance distribution of ultraviolet rays (Hg line spectrum of 254 nm) in a plane was measured by varying the size of the coupling window 4. The lamps for which the measurement was performed were the center lamp 2 - 1 and the topmost lamp 2 - 2 as viewed in Fig. 13. The ultraviolet emission was measured by means of a detector movable in the X-direction. The detector was constituted by a photodiode having a light receiving area of 1 mm×6 mm. A filter capable of passing only the light of 254 nm in wavelength was disposed in front of the photodiode detector.

FIG. 14 shows a distribution of ultraviolet intensity measured for the case in which the coupling window 4 was dimensioned such that e=5 cm and d=10 cm (d/f=0.45). FIG. 15 shows the corresponding distribution in the case where e=5 cm and d =17 cm (d/f=0.77). As will be seen from these figures, improved uniformity in the distribution of ultraviolet intensity can be attained when the length of the coupling window 4 is selected greater than about ¾of the length f covered by the lamp array in the axial direction of the waveguide. Subsequently, the measurement was made by maintaining the length d of the coupling window 4 constant at 17 cm while varying the width e to 1 cm, 3 cm and 5 cm, respectively. The results of the measurement, shows that the microwave energy is difficult to injected into the cavity 1 as the width e is diminished. When e =3 cm, i.e. when the width e is greater than about 3/10 of that of the waveguide at the connecting portion thereof which is 10.9 cm, uniformity of the intensity distribution is equivalent to the case where e =5 cm, although the microwave energy experiences some difficulty in injection into the cavity. It has been found that injection of microwave energy becomes practically impossible when e =1 cm. The effect remains substantially unchanged even when the position of the coupling window 4 is deviated about ±5 cm from the center. Greater deviation can be tolerated when the width of the coupling window 4 is increased.

Figure 16:
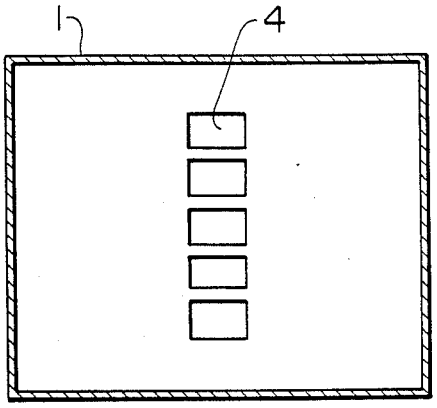
FIG. 16 is a view showing a modified structure of an energy coupling window formed in a cavity of the light source apparatus according to the invention.
Figure 17:
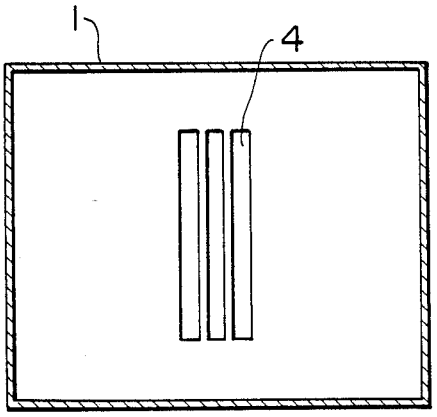
FIG. 17 is a view similar to FIG. 16 and shows another example of a structure of the coupling window.

FIGS. 16 and 17 show other configurations of the coupling window according to the invention. As will be seen from these figures, the number of the coupling window is not limited to one, but any number of the coupling windows can be formed so far as the overall window area remains same.

Figure 18:
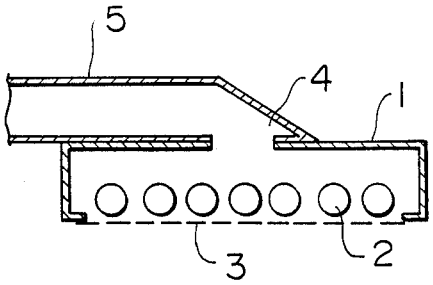
FIG. 18 is a sectional view of a cavity and shows another example of an energy coupling method.

FIG. 18 is a sectional view of a cavity and shows another example of an energy coupling method. It will be seen in FIG. 18 that the waveguide 5 may be tapered as shown when the microwave energy is injected from the top of the cavity 1.

Figure 19:
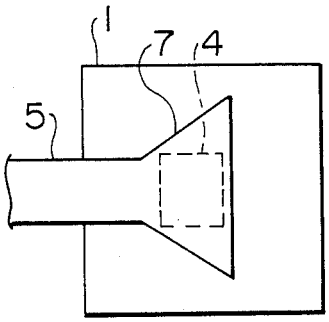
FIG. 19 is a top plan view of a cavity and shows another example of an energy coupling method.

FIG. 19 is a top plan view of a cavity and shows another example of an energy coupling method. The coupling window 4 can be enlarged by using the tapered waveguide.

In conjunction with the light source apparatus shown in FIGS. 1 and 8, it should be mentioned that the lamps 2 need not always be so disposed that the longitudinal axis thereof intersects orthogonally that of the waveguide 5. However, the disposition of the lamps shown in FIGS. 1 and 8 is preferred in view of the fact that uniformity of irradiance can be improved because plasma produced at the center of the lamp 2 spreads in the direction lengthwise of the lamp.

The light source apparatus described above are designed to be used mainly for the irradiation of semiconductor wafers. To this end, the dimensions of the cavity 1 should preferably be selected such that a =c =15 cm so that semiconductor wafer of a size greater than 5 inches (12.7 cm) in diameter can be irradiated. Further, the lamps 2 should preferably be juxtaposed with the inter-envelope distance shorter than 1 cm.

Figure 20:
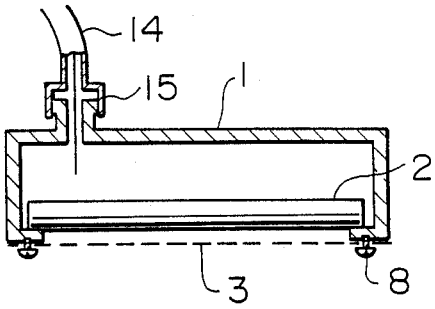
FIG. 20 is a sectional view showing a microwave coupling structure according to an embodiment of the invention.

Next, description will be made on methods of supplying the microwave energy according to other embodiments of the present invention. FIG. 20 shows an embodiment of the invention according to which the microwave energy is supplied to the cavity 1 through a coaxial cable 14 and a probe antenna 15. The latter may be realized in the form of a coupling loop having a tip end connected to the cavity 1. The use of the coaxial cable 4 is accompanied with an advantage that the location of the cavity 1 can be easily changed, which is impossible when the waveguide is employed. The length of the probe antenna should preferably be variable for the purpose of facilitating the required adjustment.

Figure 21:
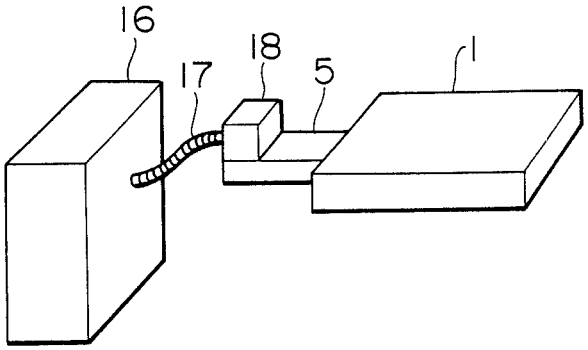
FIG. 21 is a perspective view showing a light source apparatus according to a further embodiment of the present invention.

FIG. 21 shows a microwave generator constituted by a magnetron 18 and a power supply 16 therefor provided separately according to a further embodiment of the invention. More specifically, the magnetron 18 is of a small size and is mounted on the cavity 1 by means of the interposed waveguide 5 and supplied with electric power from the power supply source 16 through a high-voltage cable 17. With this structure, the cavity 1 can be easily moved together with the magnetron 18.

Figure 22:
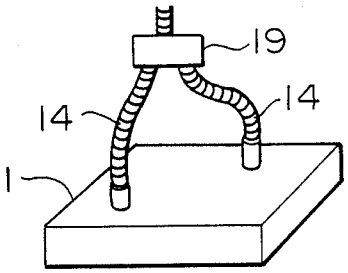
FIG. 22 is a partial perspective view showing a microwave coupling structure according to another embodiment of the invention.

FIG. 22 shows still another embodiment of the invention according to which the power is supplied to the cavity 1 at two positions thereof through a switch 19 and a coaxial cable 14. By changing over the power injection positions alternately at a high speed, improved uniformity of irradiance in a plane can be attained.

Figure 23A:
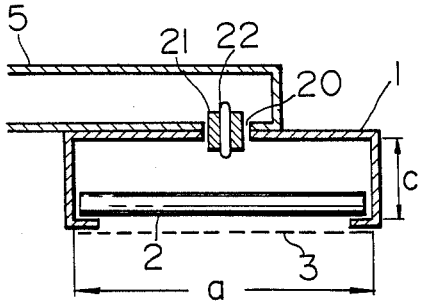
FIGS. 23A and 23B are views showing a microwave coupling structure according to still another embodiment of the invention in different sections, respectively.
Figure 23B:
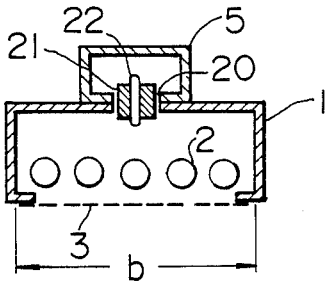

FIGS. 23A and 23B show embodiments of the invention according to which energy is supplied to the cavity 1 by means of an antenna. More specifically, FIG. 23A is a longitudinal sectional view showing the cavity 1 and the waveguide 5, while FIG. 23B is a cross sectional view of the same structure. As will be seen in these figures, holes 20 are formed in the cavity 1 and the waveguide 5 in alignment with each other, wherein an antenna 22 is inserted in the holes 20 with an insulator 21 being interposed therebetween. The insulator 21 may be made of Teflon (trade name), silicone rubber, ceramics or the like, while the antenna is made of a metal. Both the insulator 1 and the antenna 22 should preferably be provided with threads so that the antenna 22 can be moved vertically for realizing the matching.

Figure 24:
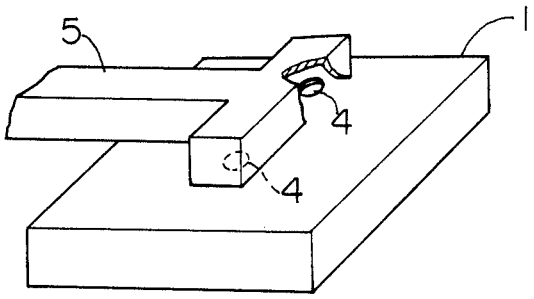
FIG. 24 is a partially broken perspective view showing a microwave coupling structure according to another embodiment of the invention.

By providing two or more coupling windows 4 at different positions as shown in FIG. 24, uniformity of radiation in a plane can further be improved.

Figure 25:
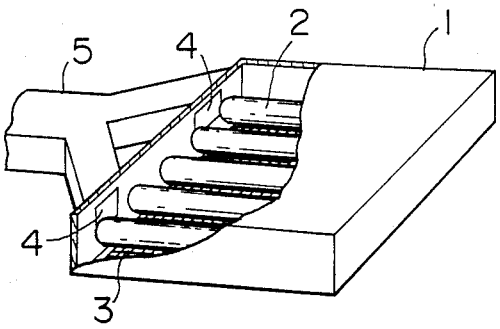
FIG. 25 is a partially broken perspective view showing a microwave coupling structure according to a further embodiment of the invention.

The same holds true in the structure in which two or more coupling windows 4 are formed in one side face of the cavity 1, as is shown in FIG. 25.

When the cavity 1 is operated in the resonant state, it is preferred that a plurality of modes make appearance simultaneously at the sides a and c, as shown in FIG. 3. By way of example, when a magnetron (having the wavelength $\lambda_0$32 12.24) is used as the microwave generator 6 and dimensions a, b and c are selected such that a=c=30.6 cm and b<6.12 cm, mode of l=3 and n=4 and mode of l=4 and n=3 (refer to the expression 1) can be established simultaneously. With this arrangement, the uniformity of radiation in a plane can be improved because the electric fields of two modes overlap each other within the cavity 1.

Figure 26:
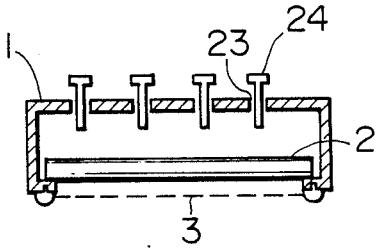
FIG. 26 is a sectional view showing a cavity structure according to another embodiment of the invention.

FIG. 26 shows a further embodiment of the present invention which allows the resonant frequency of the cavity 1 to be regulated. More specifically, a plurality of screw holes 23 are formed in the cavity 1 in which tuning screws 24 are inserted. By varying the length of the tuning screws 24, impedance matching between the microwave generator 6 and the cavity 1 can be accomplished.

Figure 27:
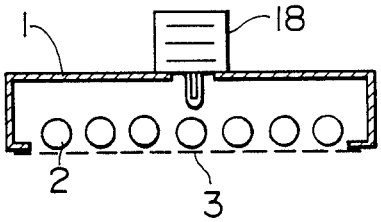
FIG. 27 is a sectional view showing a light source apparatus according to a further embodiment of the present invention.

FIG. 27 shows another embodiment of the invention according to which the magnetron 18 is directly mounted on the cavity. With this structure, the light source apparatus can be implemented in a reduced size.

When the lamp is difficult to ignite in the embodiments described above, Tesla coils may be provided in the vicinity of the lamps to aid the ignition thereof.

As will now be appreciated from the foregoing description, there is provided a light source apparatus which comprises a microwave generator, a flat-type cavity coupled to the microwave generator and lamps mounted with the cavity, wherein a part of the cavity is realized in a mesh-like structure, and a plurality of electrodeless lamps are disposed in juxtaposition in a plane so that uniform radiation can be produced. The light source apparatus can enjoy many advantages such as simplified lamp structure, no contamination by the impurities otherwise produced by electrodes, and uniform radiation suited for irradiation of a plane having a large area.

We claim:

1. A light source apparatus, comprising: means for generating microwaves of a predetermined wavelength; microwave transmitting means having one end coupled to said microwave generating means for transmitting the generated microwaves; a cavity coupled to the other end of said microwave transmitting means; and a plurality of electrodeless lamps juxtaposed with one another within said cavity in a flat array; wherein said cavity is a rectangular parallelepiped of flat configuration, opaque to said microwaves, having length, width and thickness dimensions, wherein said thickness is less than ½ of the wavelength of said microwaves, and includes a mesh-like portion transparent to light emitted from said lamps.

2. A light source apparatus according to claim 1, wherein each of said lamps has a portion projecting outwardly from said cavity.

3. A light source apparatus according to claim 1, wherein microwave input energy per unit volume of said lamp is at least 0.73 W/cm$^3$.

4. A light source apparatus according to claim 1, wherein said cavity is coupled to said microwave transmitting means through a hole having an area of at least 12 cm$^2$ and formed in one side of said cavity.

5. A light source apparatus according to claim 2, wherein said cavity is coupled to said microwave transmitting means through a hole having an area of at least 12 cm$^2$ and formed in one side of said cavity.

6. A light source apparatus according to claim 3, wherein said cavity is coupled to said microwave transmitting means through a hole having an area of at least 12 cm$^2$ and formed in one side of said cavity.

7. A light source apparatus according to claim 4, wherein said cavity is coupled to said microwave transmitting means through a hole having an area of at least 12 cm$^2$ and formed in one side of said cavity.

8. A light source apparatus according to claim 1, wherein said cavity is coupled to said microwave transmitting means through a hole having an area of at least 4.5% of that of a top side face of said cavity and formed in said top side face.

9. A light source apparatus according to claim 8, wherein said hole is apertured over at least ¾ of the length of an area covered by said lamps in the axial direction of said microwave transmitting means.

10. A light source apparatus according to claim 8, wherein said hole has a width equal to at least 3/10 of a long side of a section of said microwave transmitting means.

11. A light source apparatus, comprising: means for generating microwaves of a predeermined wavelength; microwave transmitting means having one end coupled to said microwave generating means for transmitting the generated microwaves; a cavity coupled to the other end of said microwave transmitting means; and a plurality of lamps juxtaposed with one another within said cavity in a flat array; said cavity being in the form of a rectangular parallelpiped having length, width and thickness dimensions, wherein said thickness is less than ½ of the wavelength of said microwaves, said cavity further being opaque to light emitted from said lamps and including a mesh-like portion transparent to light emitted from said lamps, and wherein the input microwave energy per unit volume of said lamp is at least 0.73 W/cm$^3$.

12. A light source apparatus, comprising: means for generating microwaves of a predetermined wavelength; microwave transmitting means having one end coupled to said microwave generating means for transmitting the generated microwaves; a cavity coupled to the other end of said microwave transmitting means; and a plurality of lamps juxtaposed with one another within said cavity in a flat array; said cavity being in the form of a rectangular parallelepiped having length, width, and thickness dimensions wherein said thickness is less than ½ of the wavelength of said microwaves, said cavity further being opaque to light emitted from said lamps and including a mesh-like portion transparent to light emitted from said lamps, and wherein each of said lamps has a portion projecting outwardly from said cavity.

13. A light source apparatus, comprising: means for generating microwaves of a predetermined wavelength; microwave transmitting means having one end coupled to said microwave generating means for transmitting the generated microwaves; a cavity coupled to the other end of said microwave transmitting means; and a plurality of lamps juxtaposed with one another within said cavity in a flat array; said cavity being in the form of a rectangular parallelepiped having length, width and thickness dimensions, wherein said thickness is less than ½ of the wavelength of said microwaves, being opaque to light emitted from said lamps, and including a mesh-like portion transparent to light emitted from said lamps, wherein each of said lamps has a portion projecting outwardly from said cavity, and further wherein the input microwave energy per unit volume of said lamp is at least 0.73 w/cm$^3$.

* * * * *